United States Patent [19]

Duncan

[11] Patent Number: 4,553,277

[45] Date of Patent: Nov. 19, 1985

[54] FAUCET AND CLAMPING MECHANISM

[76] Inventor: Ronnie J. Duncan, 12432 Shore St., Leavenworth, Wash. 98826

[21] Appl. No.: 556,373

[22] Filed: Nov. 30, 1983

[51] Int. Cl.[4] ..... B25B 5/14

[52] U.S. Cl. ..... 4/643; 137/359; 251/143; 269/34

[58] Field of Search ..... 4/643, 646, 649, 633, 4/191, 632, 634, 635, 636, 192; 269/20, 27, 30, 25, 32; 137/359; 251/143

[56] References Cited

U.S. PATENT DOCUMENTS

| | | | |
|---|---|---|---|
| 2,916,883 | 12/1959 | Geck | 269/34 X |
| 3,010,474 | 11/1961 | Moen | 4/192 X |
| 3,027,155 | 3/1962 | Paterson | 269/32 |
| 3,807,453 | 4/1974 | Dom et al. | 137/359 X |
| 4,451,026 | 5/1984 | Coope | 269/32 X |

*Primary Examiner*—Stephen Marcus
*Assistant Examiner*—Leo J. Peters
*Attorney, Agent, or Firm*—Arthur G. Yeager

[57] ABSTRACT

A faucet having a clamping mechanism having a guide and clamping arms retained by a detent in contracted position when in disengaged position for placing the faucet on a support wall with the clamping mechanism extending through an opening in the support wall. On connecting the water supply to the faucet valves, the water under pressure operates a hydraulic motor to automatically move the clamping arms toward engaged position to release the detent so a spring will expand the clamping arms to expanded position to engage the clamping side of the support wall in engaged position.

15 Claims, 13 Drawing Figures

FAUCET AND CLAMPING MECHANISM

FIELD OF THE INVENTION

This invention relates to faucets having an improved clamping mechanism for securing the faucet to a support wall such as a sink back or deck. This faucet provides an integral assembly having a housing with valving and a clamping mechanism fixed on the housing and rigidly projecting away or downward from the base of the housing for insertion through an opening in the support wall when the faucet base is positioned on the support wall. The clamping mechanism has clamp arms which contract to pass through the opening in the support wall and then expand and are moved by a movable member to engage the underside of the support wall to clamp the faucet to the support wall. The clamping mechanism has guide means, clamp arm means and a movable operating member. The guide means is mounted on the faucet housing in a fixed position extending perpendicularly away from the base of the faucet. The clamp arm means is mounted on the guide means for movement from a contracted position for insertion through an opening in the support wall to an expanded position for engaging the underside of the support wall. The operating member is movable to a disengaged position permitting movement of the clamp arm means to contracted position during insertion and then movement to expanded position so on movement of the operating member to engaged position, the clamp arm means engage the underside of the support wall to secure the faucet on the support wall.

The water lines controlled by the faucet valves when connected provide a hydrostatic pressure to automatically move the hydraulic motor means of the operating member and the clamp arm means from disengaged position and to hold it in engaged position to continuously clamp the faucet to the support wall while the faucet is used. The guide means, which extends in a fixed position away from the base of the faucet, has an arm guide portion near the base for guiding the clamp arm means for movement between contracted and expanded positions. The motor means has a cylinder to receive the operating piston which is moved by fluid under pressure and moves the arm means from disengaged to engaged or clamped and expanded position to clamp the faucet on the support wall.

In the preferred embodiment the guide means is an extension of the cylinder which is attached to the base of the faucet and has slots on opposite sides to guide the clamp arm means. The clamp arm means is an annular plastic member having a pair of oppositely disposed semicircular mounting portions guided in the cylindrical guide and each having an arm extending through a slot in the guide means for engaging the underside of a support wall for clamping the faucet on the support wall. The mounting portions are a full semicircle and are connected at each side by a plastic resilient hinge to form an annular member which is seated on the cylinder. The mounting portions taper from the hinged end to narrower portions at the other or clamping end having the clamp arms. The hinge bends when the mounting portions and arms are swung toward each other to contract the arms within the guide means and in full disengaged position retained in contracted position by detent means so the clamping mechanism may be inserted through an opening in a support wall. When fluid moves the piston and clamp arm means toward engaged position the detent means is released so the resilient hinge and/or spring means expands the arms to expanded position so on movement to engaged position the arms engage the clamping side of the support wall to clamp the fixture to the support wall.

In a modification the water pipe extends through the cylinder and an annular piston is used. A clamp arm is positioned in each slot. Each clamp arm has a rounded pivot end engaging and pivoted on the annular end of the piston. A rigid pivot pin at the center of the rounded end extends in the annular cylinder space across the slot to retain the arm in the slot during pivotal movement. In full disengaged position a detent retains the arm in contracted position and is released on movement toward engaged position so spring means moves the arm to expanded position. A flexible retainer is attached to the arm and spaced from the pivot pin to limit outward movement in the expanded position. The spring means is preferably a plastic leaf spring made integral with the plastic arms engaging the central pipe or poppet sleeve to bias the arm to expanded position.

BRIEF DESCRIPTION OF THE DRAWINGS

The novel features which are believed to be characteristic of this invention are set forth with particularity in the appended claims. The invention itself, however, both as to its organization and method of operation, together with further objects and advantage thereof, may best be understood by reference to the following description taken in connection with the accompanying drawings, in which:

DESCRIPTION OF THE PREFERRED EMBODIMENTS

Figure 1:
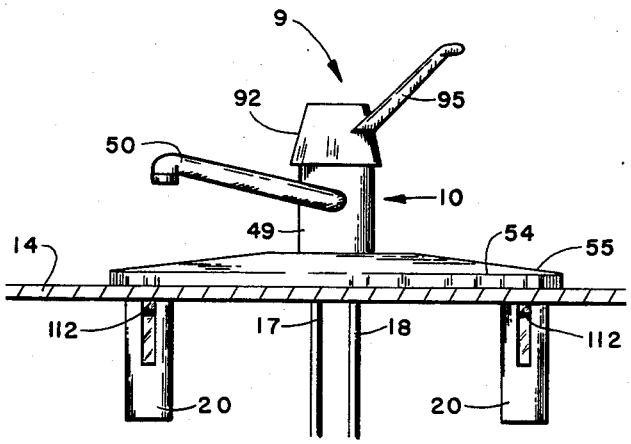
FIG. 1 is an elevation view of the faucet assembly showing the control portion and clamping mechanisms.
Figure 2:
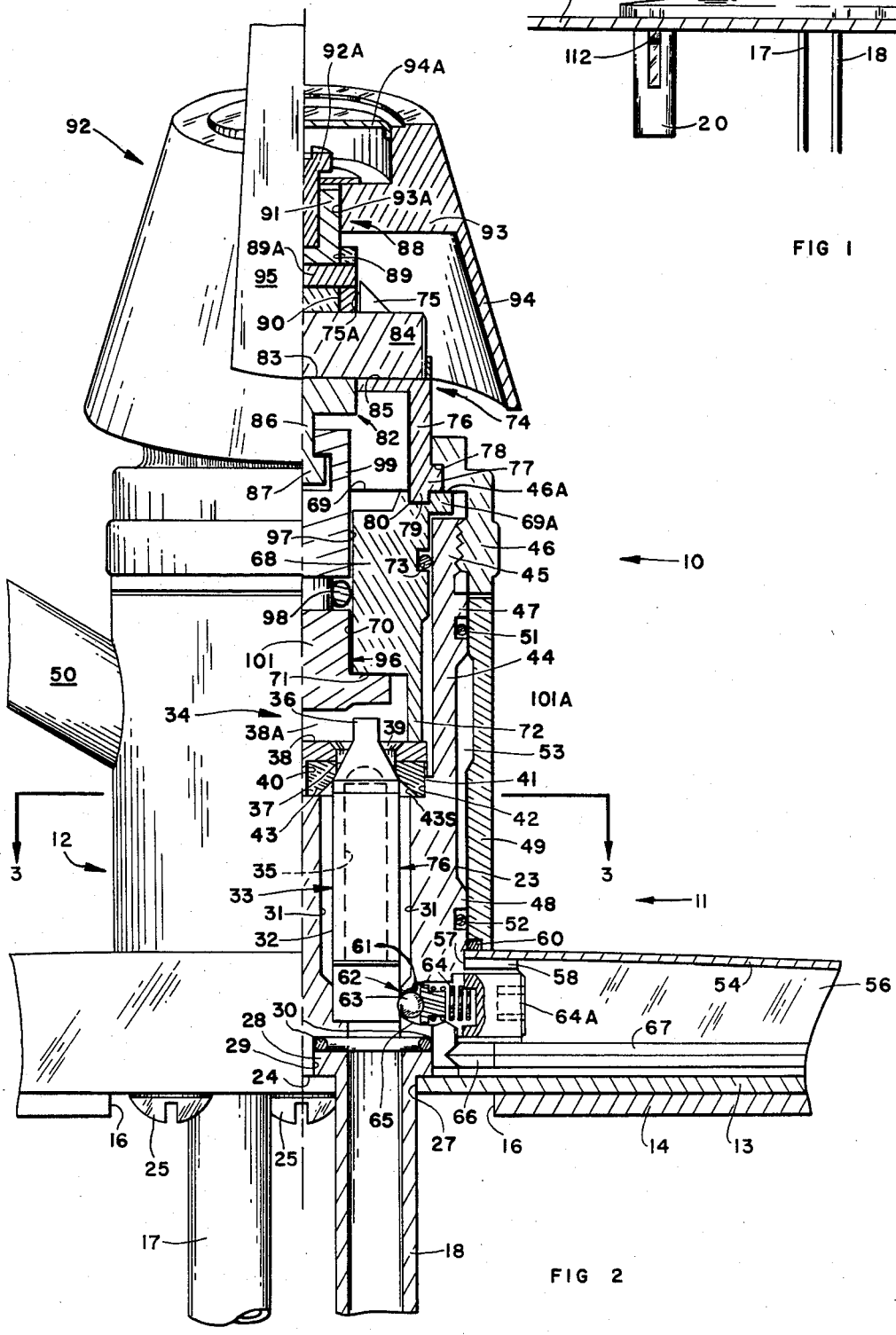
FIG. 2 is an enlarged partial elevation view of the faucet showing the control portion with parts in section on the line 2—2 of FIG. 3, with parts broken away and in section.
Figure 3:
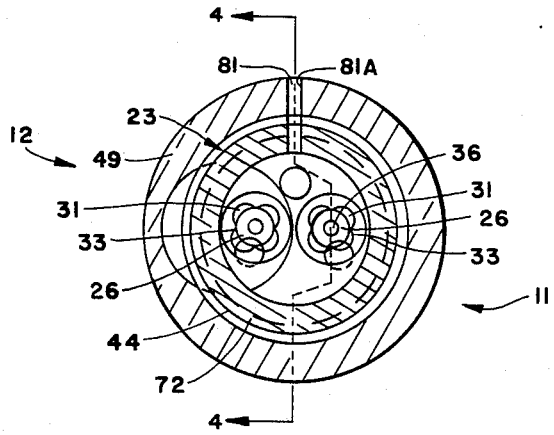
FIG. 3 is a sectional view of the control portion on the line 3—3 of FIG. 2.

The faucet fixture or assembly 9, FIGS. 1 to 7, has a central control portion 10 of the single lever control type that is symmetrical about the vertical center line so only one half, the cold water control side 11 is shown in section FIG. 2. The other or hot water control side 12 is the same and thus shown in elevation. The base 13 is a plate having an elongated rectangular shape and may be faired to rounded opposite ends. The base 13 is supported and clamped on a support wall 14 which may be a deck or back wall of a sink or counter for a sink. The base 13 has a seating side engaging the mounting side of support wall 14 while the clamp arms 112 engage the opposite clamping side of support wall 14. The support wall 14 has a central opening 16, FIG. 2, for the hot and cold water pipes 17 and 18 and a side opening 19 for each clamping mechanism 20, FIG. 5. The hot and cold water pipes 17 and 18 are connected to a known water supply or source of fluid under pressure having shut off valve means (not shown).

Figure 4:
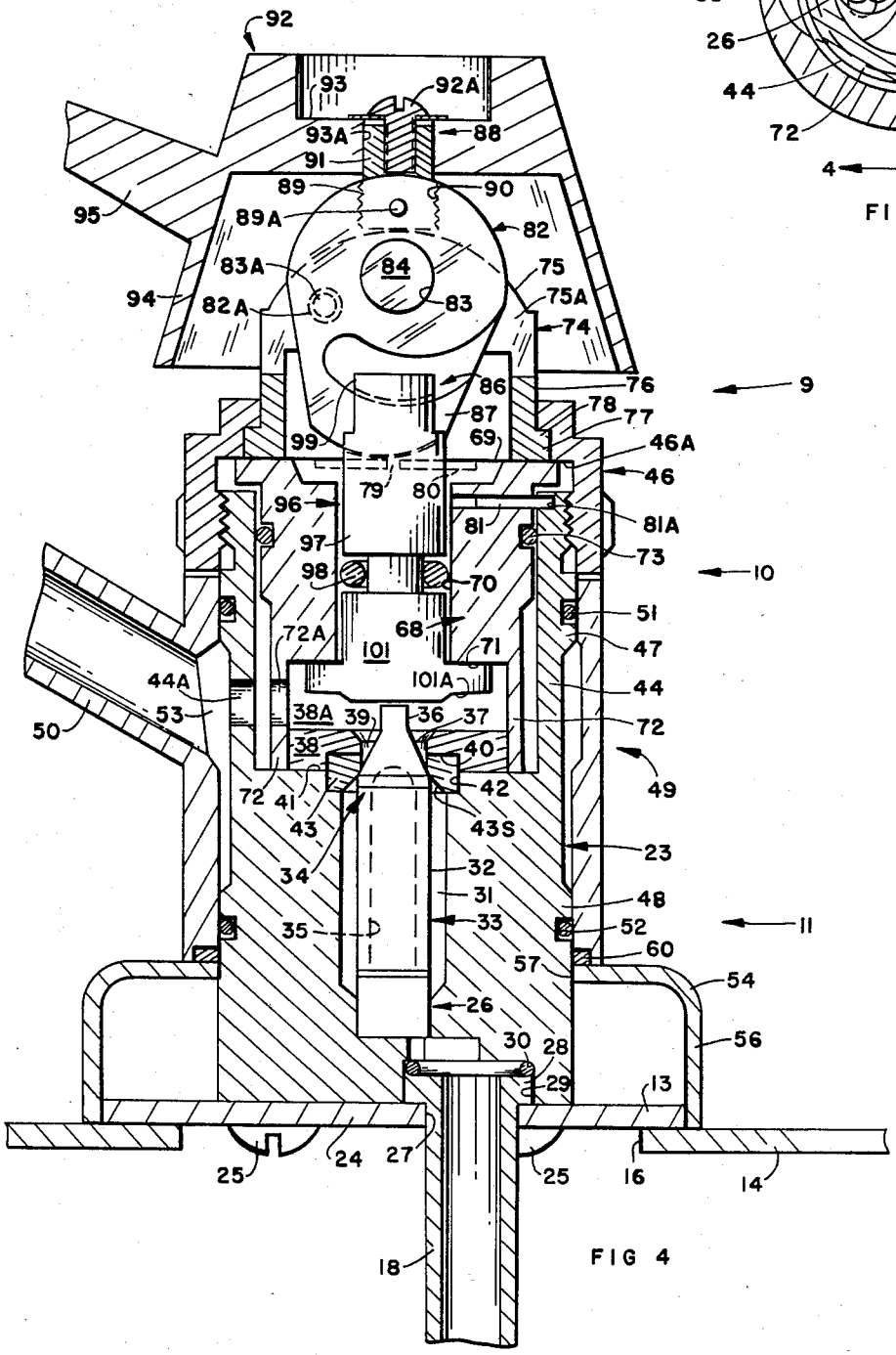
FIG. 4 is a sectional view of the control portion on its center line and one control valve on its center line as shown by line 4—4 of FIG. 3.

The valve body 23, FIGS. 2 and 4, has a bottom surface 24 engaging base 13 and is secured centrally thereon by three screws 25. A pair of passages 26 for controlled water flow extend vertically through body 23. The cold water pipe 18 passes through hole 27 in base 13 and has a flange 28 at its end fitting in a recess 29 offset and connected to cold water passage 26 in body 23 at the bottom surface 24. A seal 30 and flange 28 in recess 29 when clamped by base 13 being secured by screws 25 to body 23 seals and connects pipe 18 to cold water passage 26 in body 23. Hot water pipe 17 is similarly connected to similar hot water passage (not shown). Each passage 26 has in the upper portion a plurality, preferably four, longitudinal grooves or recesses 31, FIG. 3, in the passage wall extending from top side 41 of valve body 23 and having a length longer than the cylindrical guide portion 32 of poppet 33 of valve 34. The poppet has a hollow 35 to reduce weight. The poppet 33 at the downstream end has a valve seal 37 tapering from the diameter of the guide portion at an angle of 30° to the longitudinal axis to a smaller diameter operating stem 36 at the end of the poppet for extending through opening 39 and engaging the operating cam 101. The seat disk 38 engages the top side 41 of valve body 23 and has for each passage 26 and associated poppet 33, an opening 39 surrounded by a recess 40 on the side facing the top side 41 of valve body 23. There is a similar recess 42 in the top side 41 around each passage 26. A recess 40 in the seat disk 38 and a recess 42 in valve body 23 are each aligned with a passage 26 and receive an annular seat 43 with part in each recess 40, 42 to locate the assembly in aligned position and so passage 26 and opening 39 provide a sealed passage. The seat 43 has a seat surface **43*s* at a 45° angle to the longitudinal axis engaging valve seal 37. The seat disk 38 engages the top side 41 of valve body 23 and annular seats 43 provide seals between seat disk 38 and valve body 23 without deforming seat surface 43*s* and annular seat 43. The cylindrical guide portion 32 and hollow 35 of poppet 33 have a small taper sufficient for casting the poppet with a plastic material, e.g. acetyl. The poppet 33 is made of hard plastic material, one having a high durometer, while the annular seat 42 is made of softer plastic material, one having a lower durometer. The annular seat 43 engages valve seal 37 close to the outer perimeter of poppet 33 so there is a large pressure differential force acting on poppet 33 in closed position to seat the valve 34. In open position the restriction of grooves 31 provide a smaller pressure differential biasing poppet 33 toward closed position to hold stem 36 in contact with operating cam 101**.

The body 23 also has a cylindrical sleeve 44 integral with or otherwise attached to the outer perimeter of the top side 41 of body 23. There is a clearance between the outer perimeter of seat disk 38 and cylindrical sleeve 44. The upper end of sleeve 44 has threads 45 to receive threaded ring nut 46. The upper and lower lands 47, 48, respectively, on sleeve 44 just below threads 45 and the lower portion of body 23, provide a mounting on which the cylindrical spout housing 49 is rotatably mounted. The spout 50 is secured to spout housing 49 between seals 51, 52, each being an O-ring in a recess, respectively in lands 47, 48 to seal the top and bottom of flow chamber 53 between spout housing 49 and body 23. The hot and cold water valves 34 supply water to mixing chamber **38*a* FIG. 4 between seat disk 38 and guide member 68 through opening 72*a* in sleeve 72 of the guide member 68 and through opening 44*a* in sleeve 44 of valve body 23 to flow chamber 53 to supply spout 50**.

The cover 54 fits over base 10 and has a faired portion 55 with a flange 56 at the perimeter fitting the outer perimeter of base 13 and a central opening 57 fitting around land 48 at the lower edge and abutting a stop shoulder 58 on body 23. The spout housing 49 has a washer 60 at the bottom engaging cover 54 to facilitate rotation and axially locate spout housing 49.

Each passage 26 has a transverse passage 61 through body 23 having a check valve 62 with the valve member or ball 63 biased by spring 64 to engage valve seat 65. A guide element **62*a* slides in passage 61, has a recess in the end engaging the ball to aid in centering the ball and fits in the spring for guiding the spring. An abutment plug 64*a*, a pipe plug with an Allen wrench socket, is threaded into the end of transverse passage 61 to seal the passage and provide an abutment for spring 64. The passage 61 is connected by a branch passage 66 extending from transverse passage 61 between valve seat 65 and plug 64*a* to the side of body 23, like an elbow fitting. Branch passage 66 is connected by tube 67 to supply water to the hydrostatic clamping mechanism 20. The ball 63 projects in the check valve closed position into passage 26 so, after shutting off the water supply, depressing valve poppet 33 down in passage 26 will open valve 34 and engage ball 63 to open check valve 62 to exhaust and release clamping mechanism 20. Also plug 64*a* may be removed to open check valve 62 to release fluid from clamping mechanism 20 to release the clamping mechanism to remove faucet 9 from support wall 14**.

The guide member 68 is an annular sleeve and has an annular top surface 69, an inner bore 70 extending from top surface 69 to a shoulder 71 and an outer diameter having a sleeve 72 extending beyond shoulder 71 and engaging and clamping seat disk 38 against topside 41. There is a seal 73, shown as a groove and O-ring, between the outer diameter of guide member 68 and the inner surface of sleeve portion 44 of the body 23. The ring nut 46 has a first tip **46*a* engaging and clamping the top outer edge portion 69*a* of guide member 68 on the top of body sleeve 44 to hold the end of guide sleeve 72 in contact with seat disk 38 to secure and seal the annular seats 43 and seat disk 38 to the top side 41 of valve body 23 with annular seats 43 in recesses 40, 42 and aligned with passages 26**.

The pivot member 74 has a dome portion 75 and a lower cylindrical portion 76 fitting within the second or inner lip 78 of ring nut 46 and having an external ring 77 at the free end fitting into a groove provided by second lip 78 of ring nut 46 and engaging the top surface 69 of guide member 68 to retain pivot member 74 for rotation on guide member 68 which is secured on valve body 23 by ring nut 46.

The pivot member 74 has a lug 79 on each side at the transverse axis which extends into a partial circular groove 80 in the top surface 69 of guide member 68 on each side of the transverse axis. Each lug 79 extends 30 degrees and the circular groove extends 150 degrees and in the central position shown, both are centered on the transverse axis and one is a mirror image of the other. Each lug and groove permits 60° of rotation from the central position in either direction. The pin 81 fits in a transverse hole in guide member 68 and in a slot 81*a* in top of sleeve 44 of body 23 to prevent relative rotation of the guide member 68 and valve body 23. The pivot member 74 with ring 77 in groove 78 is retained for rotation relative to guide member 68 and valve body 23 within the limits established by lug 79 and groove 80.

The volume cam member 82, FIGS. 2 and 4 is rotatably mounted in a transverse slot 75*a* in dome portion 75. The volume cam member 82 has a central pivot opening 83 for pivot shaft 84 which is mounted in pivot holes 85 on each side of slot 75*a* in pivot member 74 to pivotally mount volume cam member 82 on pivot member 74. A coil spring 82*a*, FIG. 4 is seated and guided in a spring recess 83*a* in one side of volume cam member 82 and under compression engages the adjacent side of the slot 75*a* in dome portion 75 of pivot member 74 to provide friction to hold volume cam member 82 in a plurality of manually set positions. The volume cam member 82 has a thin web 86 with a curved cam element 87 at the bottom edge of web 86. The cam element 87 is a rib on both sides of web 86 having an increasing radius about the axis of pivot shaft 84 so when the handle is raised to rotate cam member 82 clockwise (FIG. 4) mixing cam 101 is moved down to open valves 34.

A mounting screw 88 has a round threaded portion 89 fastened into a threaded bore 90 in the top portion of volume cam member 82 and locked by pin 89*a*. The mounting screw 88 also has at the top a stud portion 91. The control bonnet 92 has a disk portion 93 with a mounting hole 93*a* fitting on stud portion 91 to non-rotatably secure control bonnet 92 on stud portion 91 and cam member 82. A faired annular skirt 94 extends from the perimeter of disk portion 93 and a handle 95 is secured to and projects outwardly from skirt 94. The stud portion 91 and mounting hole 93*a* have matching flats and may have a press or tapered fit to secure the control bonnet 92 non-rotatably on volume cam member 82. A fastening screw 92*a* threaded into mounting screw 88 and a washer fastens control bonnet 92 on volume cam member 82. An escutcheon plate 94*a*, FIG. 2, may be used to cover the fastening screw.

The plunger 96 has a cylindrical guide portion 97 vertically slidably mounted in inner bore 70 of guide member 68 and sealed by seal 98, preferably a groove and an O-ring in guide portion 97. The upper end of guide portion 97 has a cam follower 99, one on each side of cam element 95 engaging both the radially inner and outer surfaces of cam element 95 so plunger 96 is positively moved in both directions. At the lower end of plunger 96 there is a circular mixing cam 101 located in a horizontal plane and perpendicular to the axis of plunger 96. The mixing cam 101 has mirror image cam surfaces 101*a* on each side. The valves 34 are positioned so each stem 36 engages its cam surface 101*a* in valve open position so cam 101 on rotation will depress and open one valve 34 and permit water pressure to raise and close the other valve 34. When there is flow through recesses 31, a restricted flow, provides a pressure differential providing a closing force on poppets 33. Raising cam 101 to clear both stems 36 closes valves 34. When valve 34 is closed the full line pressure in passage 26 acts on a differential area, larger at the bottom of poppet 33, to provide a valve closing force.

There is one clamping mechanism 20 mounted in each end of base 10. Each clamping mechanism 20 has a cylinder 102 having a support ring 103 at the top and a closure 104 at the bottom or distal end. The cylinder 102 extends through a side opening 19 in support wall 14 and aligned opening 105 in base 13. The opening 105 is elongated preferably a slot extending to the end of base 13. The cylinder 102 closely fits in opening 105 and the support ring 103 rests on the top of base 13 at the side and inner edge of opening 105. Thus the spacing of cylinders 103 from the center may be adjusted by changing the length of tube 67 and sliding cylinder 102 in elongated openings 105. The tube 67 is fastened, e.g. by soldering to a fitting 106 formed in the edge support ring 103. The fitting 106 is connected by passage 107 formed in the wall of cylinder or sleeve 102 and extending axially to the bottom of cylinder 102 between end closure 104 and piston 108. The piston 108 is slidably mounted in cylinder 102 and sealed by seal 109, preferably an O-ring in a groove in piston 108. The cylinder 102 has in the upper guide portion a pair of oppositely disposed slots 110. A clamp member 111 made of plastic, such as nylon, has a pair of clamp arms 112 each having a mounting portion 113 and an engaging portion 114. The mounting portion 113 has a partial cylindrical shape and tapers from a narrow top portion 113*a* at the top or clamping end to a larger semi-circular base portion 113*b* at the base. The clamp arms 112 are hinged together by a resilient spring hinge 115 preferably a thin integral flexible plastic connecting hinge at each side between the semi-circular base portions 113*b* at the base which biases clamp arms 112 to return to expanded position in which the semi-circular portions at the base are in a straight line and the side portions engage the inside of sleeve 102, solid lines FIG. 7. A biasing spring 116 having a coil 117 centrally located near the base of clamp member 111 and a pair of tails 118, one extending from each end of coil 117 and each having a laterally outwardly offset end portion 119 extending into a hole 120 in the upper part of each clamp arm to fasten spring 116 on the clamp arms 112 to further bias clamp arms 112 to expanded position. Each engaging portion 114 has a right triangular shape with an attaching side 121 parallel to the elements of the cylindrical mounting portion 113 and integrally or otherwise attached to the mounting portion. The engaging portion 114 extends laterally through slot 110 with the upper clamping side 122 perpendicular to the elements for engaging the underside of support wall 14 to clamp faucet 9 on support wall 14. The third or diagonal side 123 of the triangular engaging portion 114 slopes from the outer end of clamping side 122 downward to the lower end of attaching side 121 and has a detent 124, a small triangular projection about midway on the diagonal side to releasably hold clamp arms 112 in contracted position when engaging the bottom of a slot 110 as shown in phantom dotted lines FIG. 7.

Figure 7:
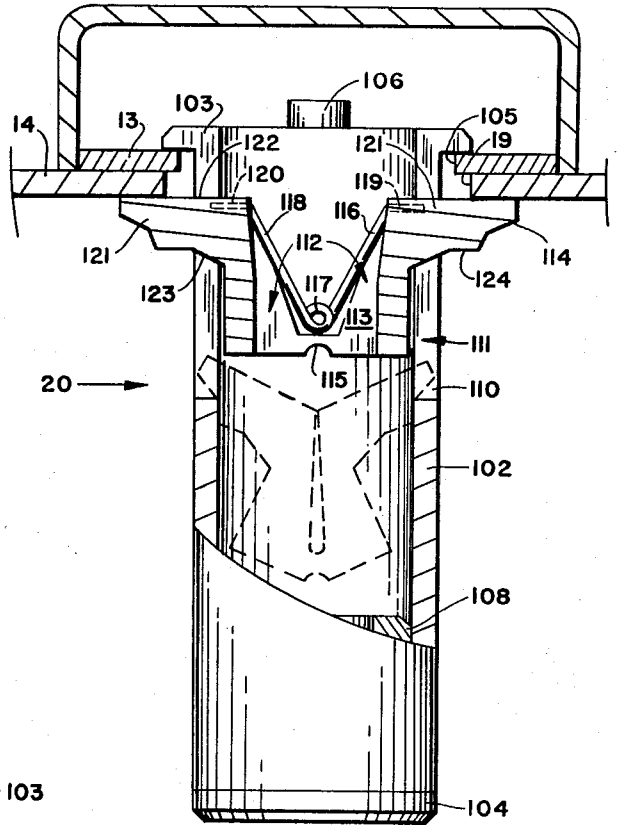
FIG. 7 is a sectional view of the clamping mechanism on the line 7—7 of FIG. 6 showing the clamp arms in expanded position in solid lines and in contracted position in phantom lines.
Figure 6:
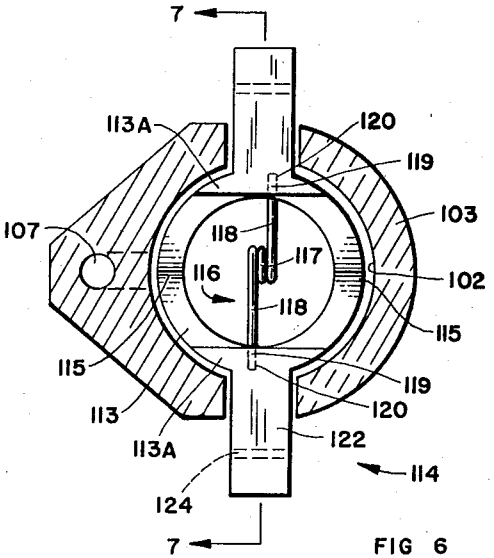
FIG. 6 is a sectional view of FIG. 5 on the line 6—6.
Figure 5:
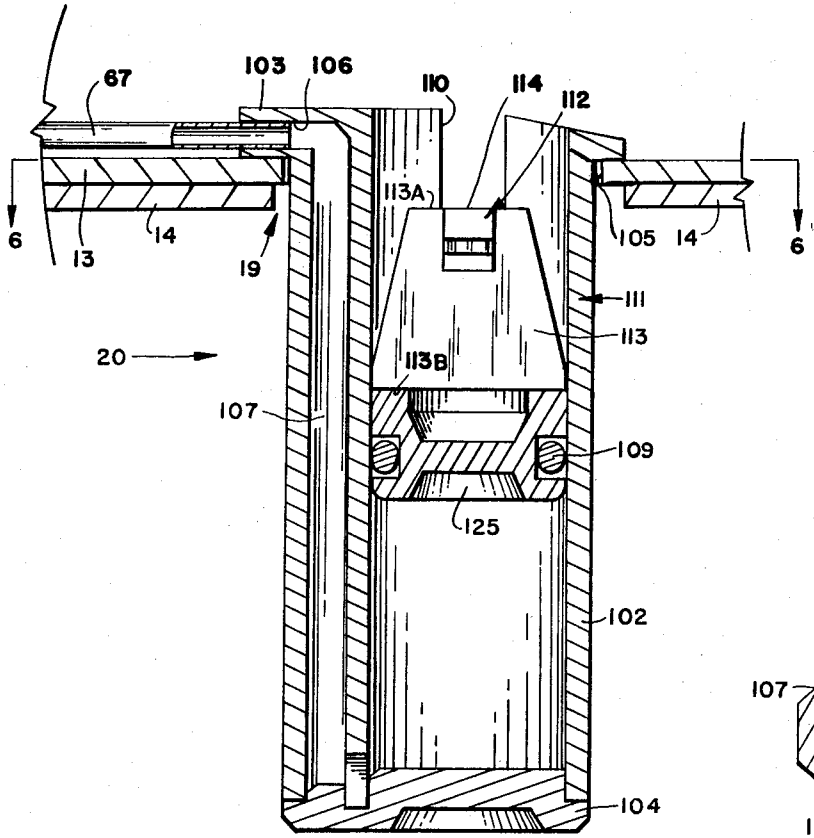
FIG. 5 is a section view of a side portion of the faucet with a clamping mechanism.
Figure 8:
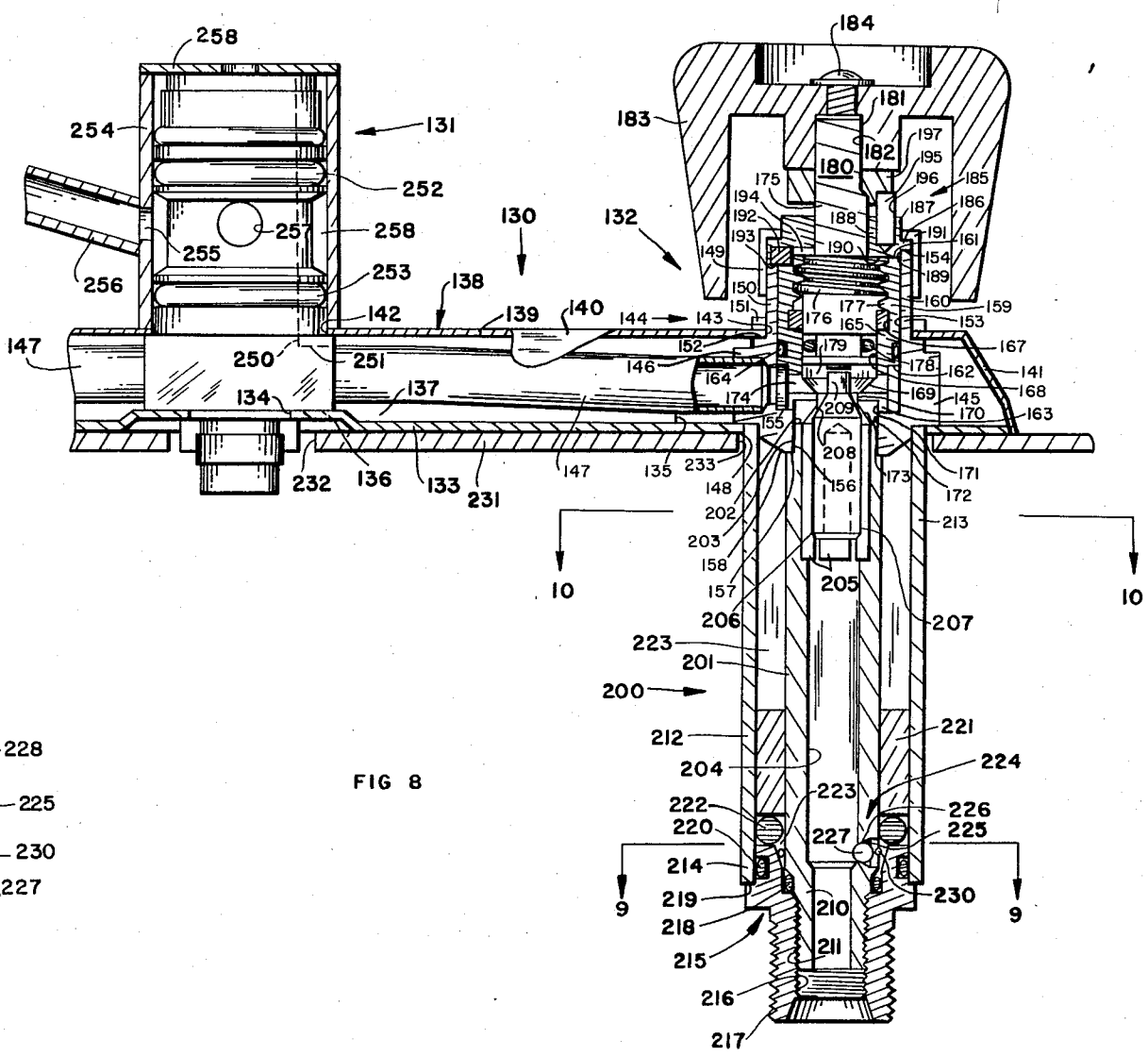
FIG. 8 is a partial elevation view with parts in section of a two handle faucet having a modified clamping mechanism.
Figure 9:
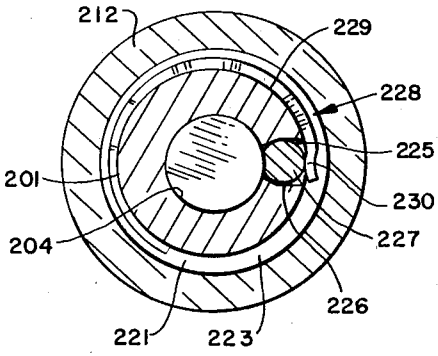
FIG. 9 is an enlarged sectional view on the line 9—9 of FIG. 8.
Figure 10:
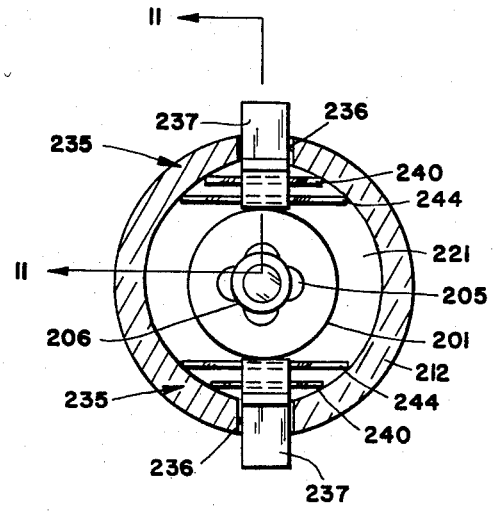
FIG. 10 is an enlarged sectional view on the line 10—10 of FIG. 8 with the clamping mechanism in engaged position.

When the faucet is assembled as shown in FIG. 1, by grasping the outer ends of an opposed pair of engaging portions, a pair of clamp arms 112 are moved toward each other and downward to the retracted position shown in dotted lines FIG. 7. During this movement to retracted position the clamp arms 112 pivot on hinge 115. The tapered sides of mounting portions 113 are about parallel. The detents 124 engage the inside of cylinder 102 just below slots 110 to releasably hold clamp arms 112 in retracted position with engaging portion 114 just within the outer perimeter of cylinder 102. The cylinder 102 and thus the clamping mechanism 20 are firmly mounted on base 13 so they project perpendicularly downward. Thus the faucet fixture 9 may be easily placed on support wall 14 with the cylinders 102 projecting through openings 19 in support wall 14 and clamp member 11 located below or on the side of support wall 14 opposite faucet 9. Then hot and cold water pipes 17, 18 are respectively connected to the hot and cold water supply. With handle 95 in closed position shown, when the water supply is turned on, water pressure acting on valves 34 immediately closes these valves. Water flows from each of passages 26 through a check valve 62, pipe 67 and passage 107 to a cylinder chamber 125 to move piston 108 and clamp member 111 upward releasing detents 124 and permitting the opposed pair of arms 112 to expand outwardly to expanded position so with continued clamping movement of piston 108, the clamping side 122 of engaging portions 114 on clamp arms 112 engage the underside of support wall 14 to clamp faucet 9 to support wall 14. In this position of clamp arms 112 the two semi-circular portions at the base form a flat annular base which seats on piston 108. The partial cylindrical portions fit inside the guide portion of cylinder 102 adjacent slots 110 to support clamp arms 112 when engaging portions 114 are engaging support wall 14. The check valve 62 holds the pressure in cylinder chamber 125 and thus clamping pressure at a substantially constant value, substantially equal to the highest supply system water pressure. Thus a later loss of pressure will not release the clamping mechanism 20 holding the faucet on the support wall 14.

When a valve seat 43 and/or poppet 33 needs replacement the water supply is turned off. Then the ring nut 46 is removed so pivot member 74 and the assembly including control bonnet 92 with handle 95, volume cam member 82, guide member 68 and plunger 96 with mixing cam 101 may be removed. Then the seat disk 38, valve seats 43 and/or valve poppets may be removed and replaced.

When it is desired to release the clamping mechanism 20 to remove the faucet from the sink 14, the above procedure for replacing valve parts is followed, except it is preferred to also disconnect pipes 18 from the fluid or water supply. Then the valve parts seat disk 39 and valve seal 37 are preferably removed so poppets 33 may be easily depressed to engage balls 63 and release the check valve 62 to exhaust passage 67. Then spout housing 49 and base cover 54 are removed. A tool is used to depress piston 108 and expel water from chamber 125 through the open check valve 62. Then clamp member 111 can be moved to the retracted position permitting removal of the faucet from support wall 14. Alternatively passage 67 may be exhausted by employing an Allen wrench to remove plug **64*a*** to similarly permit retraction of the clamping mechanism.

When the valve is in the closed position FIG. 2, the handle 95 is in the lower position and cam element 87 on volume cam member 82 and mixing cam 101 on plunger 96 are in the raised position clearing both stems 36 on poppets 33 so the valves 34 are both closed. The handle 95 is lifted to rotate handle 95, bonnet 92 and volume cam member 82 about the horizontal axis of pivot shaft 84 to lower mixing cam 101 to progressively equally open both the hot and cold water valves 34 for increasing flow from both passages 26 to mixing chamber **38*a* for flow through openings 72*a* and 44*a* respectively in sleeve 72 of guide member 68 and sleeve portion 44 of valve body 23 to flow chamber 53 and through spout 50. Rotation of handle 95 rotates the pivot member 74, volume cam member 82, plunger 96 and mixing cam 101 about the vertical central pivot axis. Rotation to the right will gradually depress and open the right (cold water) valve 34 and close the left (hot water) valve 34** if it is open. Movement of the handle to the left has the opposite effect.

MODIFICATION

The modified faucet fixture 130 FIGS. 8 to 13, of the dual handle type, has a distribution center 131 and hot and cold water control valves 132 on opposite sides. Since the control valves are identical only the cold water control valve 132 is shown and described. The distribution center 131 and both control valves 132 are mounted on the base 133 respectively at the central opening 134 and the side opening 135. The base 133 has a rectangular shape with a central raised portion 136 around central opening 134 on which distribution center 131 is secured. The base 133 has stiffening flanges 137 along its long sides. A cover 138 also of rectangular shape has a top 139, sides 140 and similar ends 141 and fits over base 133. The cover top 139 has a central opening 142 and a side opening 143 for each control valve 132.

The control valve 132 has a valve housing 144 of cylindrical sleeve shape having a large base portion 145 with a fitting opening 146 extending transverse through the sleeve. The tube 147 for connecting water from control valve 132 to distribution center 131 is secured, e.g. by soldering to fitting opening 146. The lower outer edge of base portion 145 has a bottom annular shoulder 148 to receive the cylinder sleeve 212. Above base portion 145 there is a thin sleeve 149 of smaller external diameter than base portion 145 having external threads 150 for a nut 151. The sleeve 149 fits through side opening 143 in cover 138 which seats on a top annular shoulder 152 so nut 151 secures cover 138 to valve housing 144. The valve housing 144 has a stepped bore providing a large diameter bore 153 extending from top end 154 to an annular step 155 just below fitting opening 146 and a short small diameter bore 156 extending to the bottom end 157 having a bevel 158 to the outer diameter below bottom shoulder 148.

The valve body 159 has an outer diameter 160 fitting in large diameter bore 153 from a top end 161 to an annular recess 162 at the bottom end 163 which seats on annular step 155. Seal 164, a groove and O-ring in outer diameter 160 seals valve body 159 in large diameter bore 153 of valve housing 144. The valve body 159 has in the through central opening 165 left hand acme threads 166 for the valve stem 175 extending from top end 161 to relief recess 167, a sealing bore 168, a tapered portion 169, a smaller diameter opening 170 and a recess 171 having the same diameter as small diameter bore 156 at bottom end 163. An annular valve seat 172 of soft plastic material fits in bore 156 and recess 171 to provide a seal between valve body 159 and valve housing 144 and has a 45° valve seat surface 173 facing down to be engaged by poppet 206. When the poppet is open water flows through annular valve seat 172 to central opening 165 in tapered portion 169, through radial openings 174 to annular recess 162 which provides a passage around valve body 159 and inside valve housing 144 to fitting opening 146 and tube 147.

The valve stem 175 has external threads 176 fitting internal threads 166 and a cylindrical guide surface 177 having a seal 178, preferably an O-ring in a groove, providing a seal between valve stem 175 and valve body 159. Valve stem 175 has an abutment 179 on the bottom and for engaging poppet 206 and a handle mounting portion 180 having a flat 181 fitting bore 182 in handle 183 to non-rotatably secure handle 183 to valve stem 175. A screw 176 extends through handle 183 and is threaded into the end of mounting portion 180 of valve stem 175 to secure handle 183 on valve stem 175.

An annular cap 185 has a central opening 186 rotatably receiving handle mounting portion 180 of valve stem 175 and an outer diameter 187, a ring 188 seated on the top end 154 of valve housing 144, a short annular locating portion 189 fitting into large diameter bore 153 at top end 154 and a bottom end 190 engaging top end 161 of valve body 159. A ring nut 191 is threaded on thread 150 of sleeve 149, fits around outer diameter 187 and engages ring 188 of cap 185 to secure cap 185 on valve housing 144, the valve body 159 in housing 144 and stem 175 in valve body 159. A key 192 is secured on or in a groove in the top end 161 of valve body 159, fits in a slot or keyway 193 in top end 154 of valve housing 144 and a radial groove or keyway 194 in bottom end 190 of cap 185 to non-rotatably position cap 185, valve body 159 and valve housing 144. A pin 195 is secured in a hole 196 in the top of cap 185 and extends between a pair of stops 197 on handle 183 to limit rotary movement of handle 183 to about 15°.

The valve and clamping mechanism 200 extends below base 133. The poppet sleeve 201 has at the top end 202 an external recess 203 having a light press fit in small diameter bore 156 of valve housing 144 until the shoulder at the end of recess 203 engages bottom end 157 of valve housing 144 to fasten and seal poppet sleeve 201 to valve housing 144. Also the top end of poppet sleeve 201 lightly engages valve seat 172 to secure and hold valve seat 172 in recess 171 without deformation of its surface 173. The poppet sleeve 201 has a central through bore or opening 204 having at top end 202 four longitudinally extending grooves 205 like the above grooves 31. The poppet 206 is like the above poppet 33 and has a cylindrical guide surface 207, a 30° tapered seal 208 engaging seat 172 and a stem 209 for engaging abutment 179. At the lower end poppet sleeve 201 has a fastening portion 210 of slightly smaller diameter having external threads 211.

The cylinder sleeve 212 for the hydrostatic clamping means described below has a larger internal diameter than the external diameter of poppet sleeve 201 and is concentrically positioned by the top end 213 engaging bottom annular shoulder 148 around the bottom of valve housing 144 and at the bottom end 214 by connector 215. The connector 215 is annular and has internal threads 216 threaded on threads 211 of fastening portion 210 to secure connector 215 to poppet sleeve 201 and external threads 217 for connecting to the water supply. A seal 218, preferably an O-ring in a groove provided by opposed steps in the poppet sleeve 201 and connector 215. The connector 215 has an external recess 219 receiving lower end 214 of cylinder sleeve 212 to locate and clamp cylindrical sleeve against bottom annular shoulder 148. The seal 220, an O-ring in a groove in connector 215, provides a seal between the connector 215 and cylindrical sleeve 212. An annular piston 221 with an O-ring seal 222 at its lower end fits in the annular cylinder space 226 between poppet sleeve 206 and cylinder sleeve 212. At the bottom of the annular cylindrical space 223 a check valve 224 permits flow of water from the through bore 204 which is connected to the water supply one way to cylinder space 223 and prevents return or exhaust flow. Check valve 224, FIGS. 8 and 9, has a passage 225 from bore 204 to cylinder space 223 having a seat 226 which is engaged by ball 227 under the bias of spring 228. Spring 228 is circular, seats in a groove 229, extends about two thirds around the perimeter and has an operating end 230 extending into and across passage 225 for engaging and biasing ball 227 to seal on seat 226.

When faucet fixture 130 is positioned on support wall 231 the distribution center 131 is over central opening 231 and each valve and clamping mechanism 200 extends through a side opening 233. A clamp arm 235 is positioned in each of the oppositely disposed slots 236 on each cylinder sleeve 212. The clamp arms 235 are made of plastic and are slidably mounted in slots 236 extending longitudinally from the top to a slot end 237 centrally of each cylinder sleeve 212. Clamp arms 235 have an arm portion 238 having a rounded end 239 having a first retainer pin 240 extending in cylinder space 223 to retain rounded end 239 in cylindrical space 223 for abutting the top of piston 221. The arm portion 238 has a clamping end 241 positioned at an angle, e.g., 60°, to the longitudinal axis for engaging the underside of support wall 231. Clamp arm 235 also has a leaf spring portion 242 integral with arm 235 at the shorter inner side of clamping end 241 and extending part way toward and spaced from rounded end 239. In the contracted position shown in FIG. 11, the stop portion 243 engages the inside of cylinder sleeve 212 and leaf spring portion 242 is compressed against the outside of poppet sleeve 201 so clamping end 241 is substantially within cylinder sleeve 212. A second retainer pin 244 in arm portion 238 axially above first retainer pin 240 extends freely in cylinder space 223. The retainer pins 240, 244 are secured in holes in arm portion 238.

Figure 11:
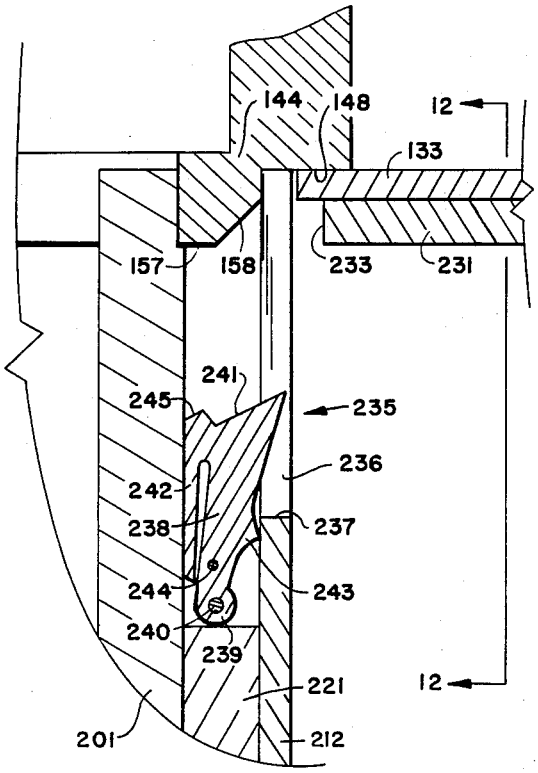
FIG. 11 is an enlarged partial sectional view on the line 11—11 of FIG. 10 showing a clamping mechanism arm in disengaged contracted position.
Figure 12:
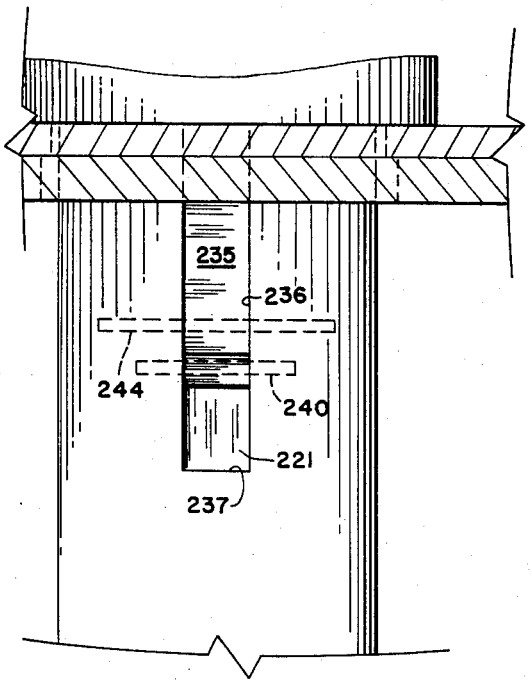
FIG. 12 is a partial elevation showing the clamping mechanism in a partially raised position.

When the water is connected to the opening 204 in poppet sleeve 201 to supply control valve 132 it is also connected by check valve 224 to cylinder space or annular cylinder 223 to move piston 221 and clamp arm 235 from the release and contracted position FIG. 11 in which clamping mechanism 200 is moved through side opening 233 in support wall 231 to the engaged and expanded position FIG. 12. As piston 221 moves clamp arm 235 the stop portion moves into slot 236 and leaf spring portion 242 straightens and tilts clamp arm 235 substantially to the angular position shown limited by first retainer pin 240 and second retainer pin 244 and in which clamping end 241 engages the underside of support wall 231. In clamping position stop 245 on clamping surface 241 engages in side opening 233 to positively position clamp arm 235. The rounded end 239 engages the outside of poppet sleeve 201 and the top of piston 221.

Figure 13:
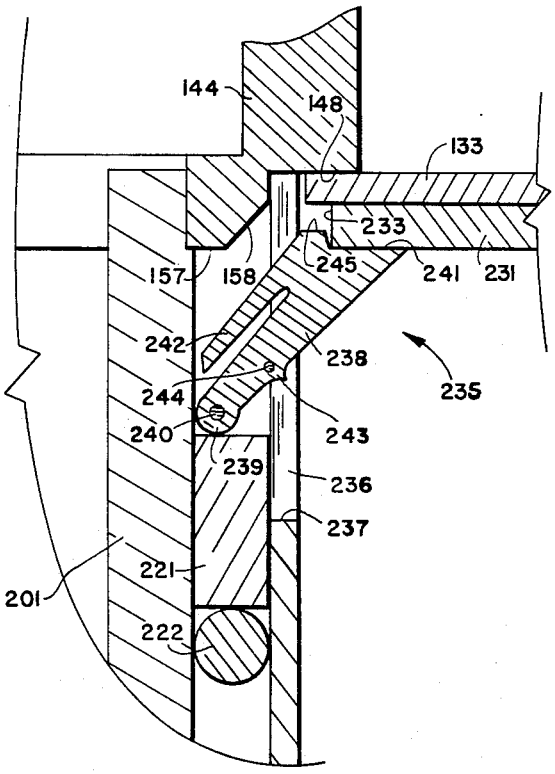
FIG. 13 is a partial sectional view like FIG. 11 showing the clamping mechanism arm in engaged expanded position.

Thus to fasten these faucet fixtures on a sink it is only necessary to place the fixture on the support wall with the clamping mechanism extending through an opening and to connect and turn on the water supply which automatically clamps the faucet on the support wall FIG. 13.

To remove the faucet the water is turned off and the pipe is disconnected. Then stem 175 is removed so poppet 206 may be pushed with a tool to the end of opening 204 to engage ball 227 and open check valve 224 to exhaust cylinder space 223 so the clamping mechanism 200 may be moved to released contracted position. When piston 221 and arms 235 are moved to released position the cams 235 will automatically be moved to contracted position FIG. 11.

The hot and cold water tubes 147 are connected to passage 250 in center support 251 which is mounted on central raised portion 136 of base 133. The center support 251 has upper and lower lands with seals 252, 253 on which spout sleeve 254, having opening 255 supplying spout 256 is mounted. Water is supplied from passage 250 through hole 257 in center support 251 to chamber 258 between lands 252, 253 and center support and spout sleeve 254 and then spout hole 255 and spout 256. A cap 258 is threadably fastened and sealed on the top of center support 251 to retain spout sleeve 254 on support 251.

While upper or top and lower or bottom have been used for convenience in the above description of drawings showing vertically mounted faucets, it will be appreciated that the faucets may be mounted vertically or horizontally.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and that it is desired to secure by Letters Patent of the United States is:

1. A faucet fixture assembly comprising a housing including a base having a seating side for mounting on the mounting side of a support wall with an opposite clamping side and an opening, control valve means mounted on said housing and having connecting means for connection to a source of fluid under pressure and valve means for controlling the delivery of fluid from said source, clamping means having support means mounted on said housing and projecting from said seating side of said base, clamp arm means mounted on said support means spaced from said base having a disengaged contracted position in which said clamping means passes through the opening when said housing is mounted with the seating side of the base on the mounting side of a support wall and fluid motor means connected to said source of fluid under pressure and operating in response to fluid under pressure to move said clamp arm means from normal disengaged contracted position to engaged expanded position engaging the clamping side of the support wall to secure said faucet fixture assembly on a support wall.

2. The invention defined in claim 1 and said clamp arm means having a detent engaging said support means when said clamp arm means is in fully disengaged and retracted position for retaining said clamp arm means in fully disengaged and retracted position and said fluid motor means releasing said detent on initial movement toward engaged position and spring means then moving said clamp arm means to expanded position and said fluid motor means moving said clamp arm means to engaged clamping position.

3. The invention defined in claim 1 and said support means and fluid motor means being a cylindrical sleeve having one end mounted on said base and having guide means adjacent said base in which said clamp arm means is swingably mounted, an end closure at the distal end of said cylindrical sleeve, a piston in said cylindrical sleeve enclosing a fluid motor chamber between said end closure and piston and passage means connected to said connecting means operative when said connecting means connects the source of fluid to said control valve means to supply fluid under pressure to said fluid motor chamber to move said piston and clamp arm means from disengaged contracted position to engaged expanded position to clamp said faucet fixture assembly on a support wall.

4. The invention defined in claim 3 and said guide means of said cylindrical sleeve being the inner diameter and oppositely disposed slots in the guide portion of said cylinder sleeve adjacent said base and said clamp arm means having a cylindrical mounting portion inside said cylindrical sleeve and an engaging portion extending through each of said slots in expanded position.

5. The invention defined in claim 4 and said clamp arm means having a pair of clamp arms each having a mounting portion and an engaging portion, each of said mounting portions has a base seated on said piston and a small upper portion to which said engaging portion is attached permitting inward swinging movement to contracted position and spring means biasing said clamp arms from contracted to expanded position.

6. The invention defined in claim 5 and hinge means between said bases of said pairs of clamp arms for hinged swinging movement between contracted position and expanded position.

7. The invention defined in claim 2 and said passage means having check valve means permitting flow to said fluid motor chamber and preventing return flow.

8. The invention defined in claim 7 and said passage means having manually controlled exhaust means between said check valve means and said fluid motor chamber to exhaust said fluid motor chamber for permitting movement of said clamp arm means to disengaged position for removing said faucet fixture assembly from a support wall.

9. The invention defined in claim 7 and said control valve means being operable for manual movement to open said check valve means for exhausting said fluid motor chamber for permitting movement of said clamp arm means to disengaged position for removing said faucet fixture assembly from a support wall.

10. The invention defined in claim 9 and said control valve means having a poppet having a closed and a normal open position, cam means for moving said poppet between said closed and normal open positions, and said poppet being manually movable further to a further open position and also engaging and opening said check valve.

11. The invention defined in claim 10 and said guide means being the inner diameter and diametrically opposite slots in said sleeve between said one end and said fluid motor chamber and said clamp arm means comprising an opposed pair of arms each having a mounting portion with a base for engaging said piston, a side for engaging the inside of said sleeve and a narrow top and each having an engaging portion attached to said side for extending through one slot, hinge means pivotally connecting said bases for pivotal movement of said arms from contracted position with said engaging portions substantially within the outer diameter of said sleeve to expanded position with said sides engaging said inner diameter of said sleeve and said engaging portions extending through said slots for engaging the clamping side of a support wall, spring means biasing said arm from said contracted position to said expanded position and detent means operative in a disengaged position to hold said arms in contracted position and on movement by said piston toward engaged position releasing said arms for movement by said spring means to expanded position.

12. The invention defined in claim 1 and said support means being concentric cylindrical inner and outer sleeves, said inner sleeve being said connecting means for connection of said control valve means to a source of fluid under pressure, said outer sleeve having a guide portion with oppositely disposed longitudinal slots adjacent said base, an end closure at the distal end of said inner and outer sleeves and said sleeves provides an annular cylinder space between said slots and said end closure, an annular piston slidable in said annular cylinder space to provide said fluid motor means, said clamp arm means comprising a pair of arms swingably mounted on said piston and extending through said slots for movement from said disengaged contracted position to said engaged expanded position on the supply of fluid to said cylinder space to move said piston toward said base.

13. The invention defined in claim 12 and each of said clamp arms having a pivot end pivotally engaging the adjacent end of said annular piston, a retainer pin extending transversely through said pivot end of each of said clamp arms and engaging the inner surface of said outer sleeve on opposite sides of each of said slots and said clamp arms to retain said clamp arm pivot end in said cylinder space.

14. The invention defined in claim 13 said clamp arm having a stop portion on the outer side and a spring on the inner side, when said clamp arm is in fully disengaged position said stop portion engages the inside of said cylindrical sleeve just below said slot and said spring is compressed to hold said clamp arm in said fully disengaged and retracted position.

15. The invention defined in claim 14 and each of said clamp arms having a second retainer pin extending from the central portion of said clamp arm transversely into the inner portion of said cylinde space in said fully disengaged and retracted position and on movement toward engaged expanded position said clamp arm is swung outwardly by said spring and said second retainer pin engages the inner surface of said outer sleeve to limit expanding movement and on said clamp arm engaging said clamping side of said support means said second retainer pin limits expanding movement of said clamp arm to an angular position for clamping said faucet fixture assembly on a support wall.

* * * * *